US006812818B2

(12) United States Patent
Lee

(10) Patent No.: US 6,812,818 B2
(45) Date of Patent: Nov. 2, 2004

(54) HIGH VOLTAGE TRANSFORMER

(75) Inventor: Kil Young Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 7 days.

(21) Appl. No.: 10/441,195

(22) Filed: May 20, 2003

(65) Prior Publication Data

US 2004/0145437 A1 Jul. 29, 2004

(30) Foreign Application Priority Data

Jan. 27, 2003 (KR) ..... 10-2003-0005181

(51) Int. Cl.[7] ..... H01F 27/08
(52) U.S. Cl. ..... 336/55
(58) Field of Search ..... 336/55–62

(56) References Cited

U.S. PATENT DOCUMENTS 4,179,927 A * 12/1979 Saaski ..... 374/152
4,307,607 A * 12/1981 Saaski et al. ..... 374/161
5,172,347 A * 12/1992 Masuda ..... 368/10
5,483,405 A * 1/1996 Kaelin ..... 361/38
6,040,664 A * 3/2000 Dieterle et al. ..... 315/383
6,697,244 B1 * 2/2004 Bauer et al. ..... 361/93.1

OTHER PUBLICATIONS

Patent Abstract of Japan No. 57–013720 filed Jan. 23, 1982.

* cited by examiner

*Primary Examiner*—Ramon M. Barrera
(74) *Attorney, Agent, or Firm*—Staas & Halsey LLP

(57) ABSTRACT

A high voltage transformer includes a fastening to fixedly attach a temperature sensor to a core. Accordingly, the present invention provides the high voltage transformer in which the temperature sensor is fixedly attached to the core, thereby preventing a shifting of a position of the temperature sensor.

20 Claims, 4 Drawing Sheets

HIGH VOLTAGE TRANSFORMER

CROSS-REFERENCE TO RELATED APPLICATIONS

This application claims the benefit of Korean Application No. 2003-5181, filed Jan. 27, 2003, in the Korean Intellectual Property Office, the disclosure of which is incorporated herein by reference.

BACKGROUND OF THE INVENTION

1. Field of the Invention

The present invention relates, in general, to a high voltage transformer and, more particularly, to a high voltage transformer provided with a temperature sensor to sense a temperature of a coil of the transformer.

2. Description of the Related Art

A high voltage transformer is a device that functions to boost an input voltage supplied from an external power supply to a high voltage and output the boosted voltage, and is generally used in electronic products such as a microwave oven.

The high voltage transformer is manufactured by joining a laminated E core, in which a plurality of E iron cores are laminated, with a laminated I core, in which a plurality of I iron cores are laminated, and disposing electrical parts such as a primary coil and a secondary coil between the laminated E core and the laminated I core.

Generally, the high voltage transformer is electrically connected between the external power supply and a load, functions to boost voltage supplied from the external power supply, and supplies the boosted voltage to the load. If the high voltage transformer is heated, a temperature of the secondary coil of the transformer connected to the load is excessively increased.

A high voltage transformer utilized in electronic products operated using a high voltage such as a microwave oven, is provided with a temperature sensor to prevent overheating. The temperature sensor is disposed in a vicinity of the secondary coil of the transformer to control an operation of the transformer based on the temperature of the secondary coil. The temperature sensor is electrically connected in series to the primary coil of the transformer. If the temperature of the secondary coil is equal to or higher than a preset temperature, the operation of the high voltage transformer is stopped by cutting off power supplied to the primary coil.

The temperature sensor that senses the temperature of the secondary coil of the high voltage transformer is installed by hand. Thus, the temperature sensor is disposed in the vicinity of the secondary coil without being fixed. If the temperature sensor is moved from an initial position, it is difficult to correctly sense the temperature of the secondary coil. Accordingly, there is an inconvenience in that it is determined whether the temperature sensor is disposed in the initial position at a time of manufacturing the high voltage transformer.

Additionally, although the temperature sensor is disposed in the initial position at the time of manufacturing the high voltage transformer, the temperature sensor may be moved from the initial position due to vibration which may be generated during the operation of the high voltage transformer. Accordingly, a method of stably installing the temperature sensor and correctly sensing the temperature of the secondary coil is needed.

SUMMARY OF THE INVENTION

Accordingly, it is an aspect of the present invention to provide a high voltage transformer to prevent a shifting of a position of a temperature sensor, thereby correctly sensing a temperature of a coil of the transformer.

Additional aspects and advantages of the invention will be set forth in part in the description which follows and, in part, will be obvious from the description, or may be learned by practice of the invention.

The foregoing and/or other aspects of the present invention are achieved by providing a high voltage transformer including a core, a coil disposed in the core, a temperature sensor to sense a temperature of the coil, and a fastening unit to fixedly attach the temperature sensor to the core.

According to an aspect of the invention, the fastening unit includes a shield cover to allow the temperature sensor to be fitted therein, and a rivet to fasten the shield cover to the core.

The shield cover includes a fastening hole to allow the rivet to penetrate therethrough.

The fastening unit fixedly attaches both the shield cover and a ground element that grounds the coil.

The shield cover is made of an insulating material.

The foregoing and/or other aspects of the present invention are achieved by providing a high voltage transformer including an E core and an I core joined together, and a primary coil and a secondary coil. The secondary coil is disposed in a space provided in the E core. The high voltage transformer also includes a temperature sensor to sense a temperature of the secondary coil, a shield cover to allow the temperature sensor to be fitted therein, and a rivet to fixedly attach the shield cover to the E core.

The shield cover includes a fastening hole to allow the rivet to penetrate therethrough.

The rivet fixedly attaches both the shield cover and a ground element that grounds the secondary coil to the E core.

The shield cover is made of an insulating material.

BRIEF DESCRIPTION OF THE DRAWINGS

The above and/or other aspects and advantages of the present invention will become apparent and more appreciated from the following detailed description of the preferred embodiments, taken in conjunction with the accompanying drawings of which.

DETAILED DESCRIPTION OF THE PREFERRED EMBODIMENTS

Figure 1:
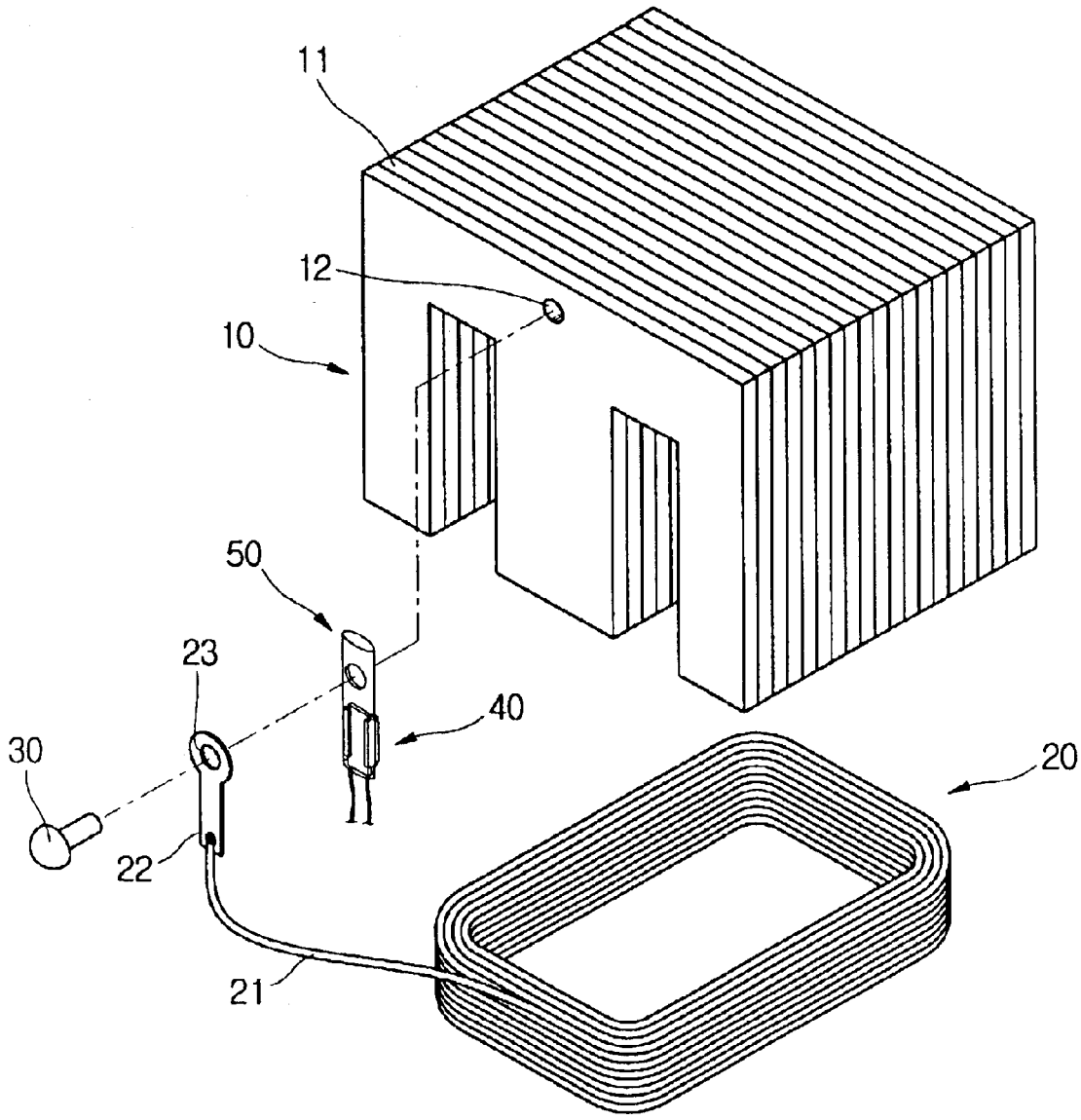
FIG. 1 is an exploded perspective view of principal parts of a high voltage transformer, according to an embodiment of the present invention.

Reference will now be made in detail to the present preferred embodiments of the present invention, examples of which are illustrated in the accompanying drawings, wherein like reference numerals refer to like elements throughout.

Figure 2:
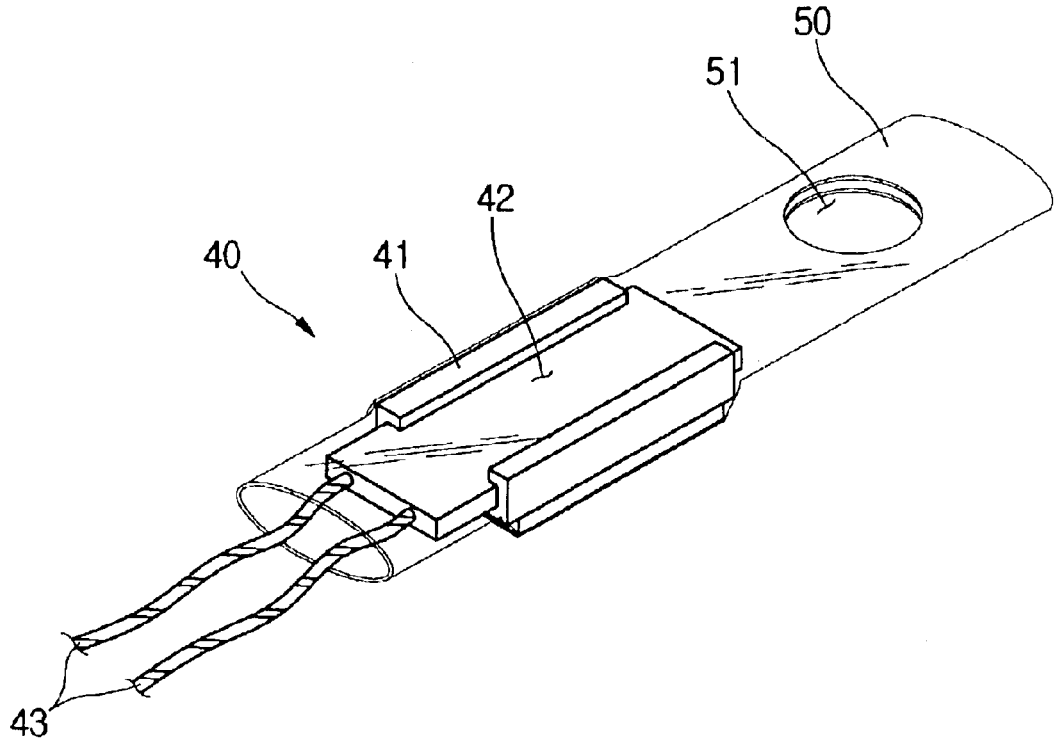
FIG. 2 is a perspective view of a temperature sensor fitted into a shield cover of the present invention.

FIG. 1 is an exploded perspective view of principal parts of a high voltage transformer, according to an embodiment of the present invention. FIG. 2 is a perspective view of a temperature sensor fitted into a shield cover of the present invention.

As shown in FIGS. 1 and 2, a high voltage transformer includes a secondary coil 20 that is inserted into a laminated E core 10 having a plurality of E iron cores 11 laminated therein, and a temperature sensor 40 that senses the temperature of the secondary coil 20.

The temperature sensor 40 includes a frame 41 to form an external shape of the sensor 40, an activating plate 42 disposed to face the secondary coil 20, and input lines 43 electrically connected to a primary coil 60 that will be described later. An on/off operation of the temperature sensor 40 is carried out in such a way that a movable contact point is attached to or detached from a fixed contact point based on the temperature sensed inside the frame 41. The movable and fixed contact points are electrically connected to the input lines 43, respectively, and are disposed under the activating plate 42. Additionally, the activating plate 42 is preferably disposed to face the secondary coil 20 whose temperature is to be sensed.

A shield cover 50 is made of an insulating material to insulate the temperature sensor 40 fitted therein, and provided to be transparent so that a user may check the temperature sensor 40 with the naked eye.

Additionally, the shield cover 50 is extended in a longitudinal direction to enclose the frame 41 of the temperature sensor 40. A surface of the frame 41 is stuck to the shield cover 50, and the frame 41 therefore does not easily slide out from the shield cover 50. The input lines 43 connected to one side of the frame 41 protrude outside the shield cover 50, and are connected in series to the primary coil 60.

The temperature sensor 40 is fixedly attached to the laminated E core 10 by a rivet 30 with the temperature sensor 40 fitted into the shield cover 50. That is, the temperature sensor 40 is fixedly attached to the laminated E core 10 by the rivet 30 after a through hole 12 of the laminated E core 10 is aligned with a fastening hole 51 of the shield cover 50.

Meanwhile, a ground line 21 is connected to one side of the secondary coil 20, and a ground element 22 is connected to the ground line 21. A fastening hole 23 is formed through the ground element 22. Accordingly, the ground element 22 is fixedly attached to the laminated E core 10 by the rivet 30 after the fastening hole 23 is aligned with the through hole 12 and the fastening hole 51.

Figure 3:
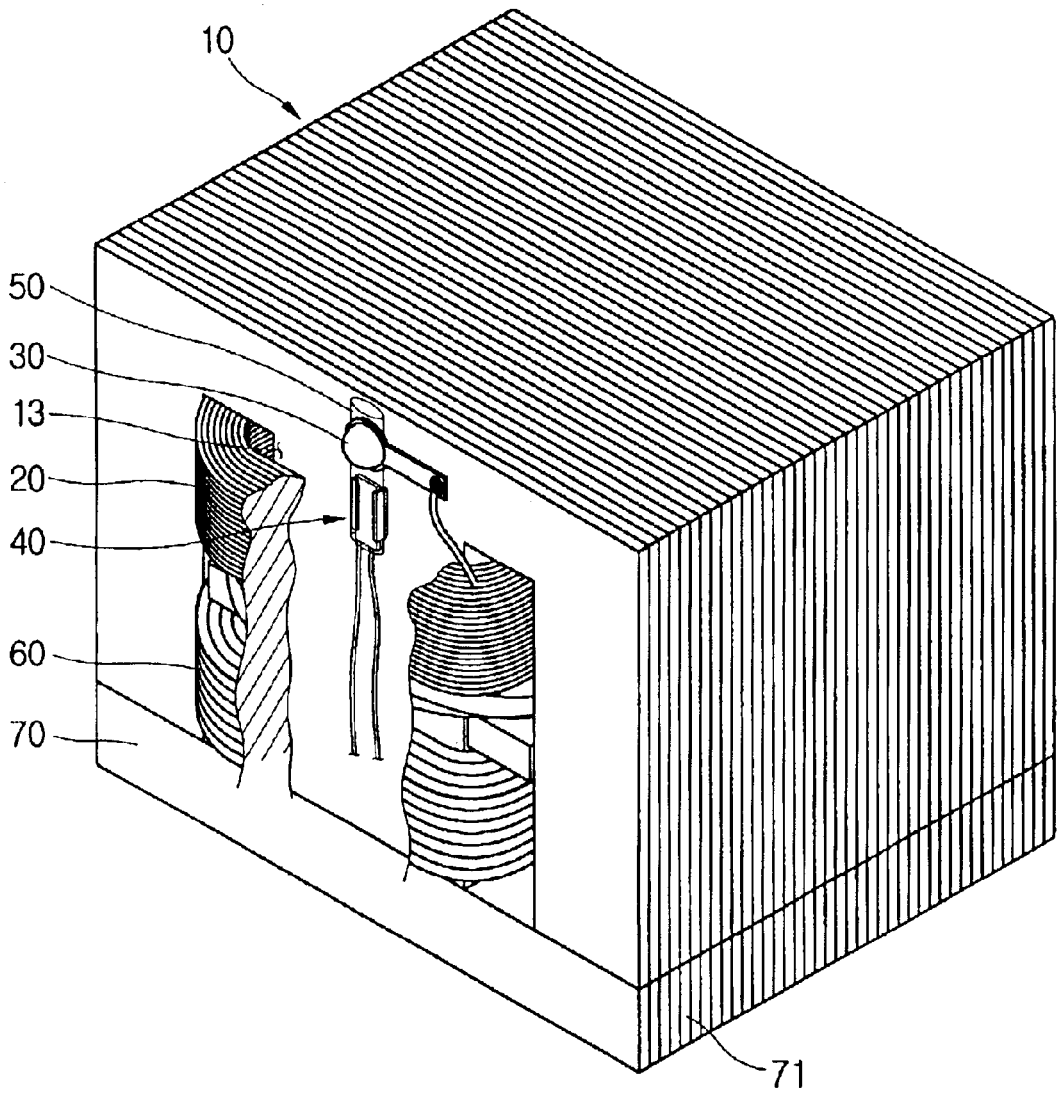
FIG. 3 shows the temperature sensor of FIG. 2 attached to a laminated E core of the high voltage transformer.

FIG. 3 shows the temperature sensor attached to the laminated E core of the high voltage transformer.

As shown in FIG. 3, in the high voltage transformer, the laminated E core 10 formed by laminating the plurality of E iron cores 11, and a laminated I core 70 formed by laminating a plurality of I iron cores 71 are joined together. Electric parts which generate a high voltage such as the secondary coil 20 and the primary coil 60, are inserted between the laminated E core 10 and the laminated I core 70.

Curved front and rear portions of the secondary coil 20 are exposed outside the laminated E core 10, and an installation space 13 is provided between the curved front portion of the secondary coil 20 and the laminated E core 10. The temperature sensor 40 fitted into the shield cover 50 is disposed in the installation space 13. Here, the temperature sensor 40 is fixedly attached to the laminated E core 10 by the rivet 30 so that the activating plate 42 of the temperature sensor 40 is situated to face the secondary coil 20. Accordingly, a shifting of a position of the temperature sensor 40 is prevented.

Figure 4:
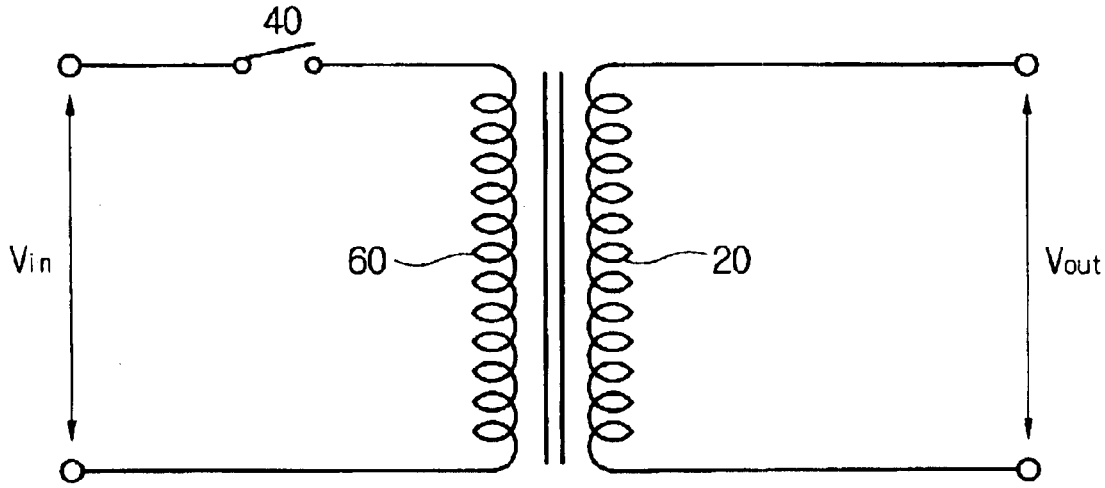
FIG. 4 is a circuit diagram illustrating the temperature sensor connected in series to a primary coil of the high voltage transformer.

FIG. 4 is a circuit diagram illustrating the temperature sensor connected in series to the primary coil of the high voltage transformer.

An input voltage $V_{in}$ is applied to the primary coil 60 and an output voltage $V_{out}$ boosted by the secondary coil 20 is output.

The temperature sensor 40 is connected in series to the primary coil 60, and the activating plate 42 of the temperature sensor 40 is disposed to face the secondary coil 20. If the temperature of the secondary coil 20 is equal to or higher than a preset temperature, the movable contact point is not connected to the fixed contact point, so that the temperature sensor 40 is turned off and the input voltage $V_{in}$ applied to the primary coil 70 is cut off. Accordingly, as an operation of the high voltage transformer is stopped, overheating of the high voltage transformer may be prevented.

As is apparent from the above description, the present invention provides a high voltage transformer, in which a temperature sensor is fixedly attached to a laminated E core by a rivet through a medium of the shield cover of the sensor, thereby preventing the shifting of the position of the temperature sensor.

Accordingly, it is not necessary to check the position of the temperature sensor at the time of manufacturing the high voltage transformer, and the temperature sensor is fixedly attached to the E core so that the activating plate of the temperature sensor is situated to face the secondary coil of the transformer. Thus, the temperature of the secondary coil may be correctly sensed, and reliability of products using the high voltage transformer may be increased.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A high voltage transformer, comprising:

a core;

a coil disposed in the core;

a temperature sensor to sense a temperature of the coil; and a fastening unit to fixedly attach the temperature sensor to the core.

2. The high voltage transformer as set forth in claim 1, wherein the fastening unit comprises:

a shield cover to allow the temperature sensor to be fitted therein; and a rivet to fasten the shield cover to the core.

3. The high voltage transformer as set forth in claim 2, wherein the shield cover comprises:

a fastening hole to allow the rivet to penetrate therethrough.

4. The high voltage transformer as set forth in claim 2, wherein the fastening unit fixedly attaches both the shield cover and a ground element that grounds the coil.

5. The high voltage transformer as set forth in claim 2, wherein the shield cover is made of an insulating material.

6. A high voltage transformer, comprising:

an E core and an I core joined together;

a primary coil and a secondary coil, the secondary coil being disposed in a space provided in the E core;

a temperature sensor to sense a temperature of the secondary coil;

a shield cover to allow the temperature sensor to be fitted therein; and a rivet to fixedly attach the shield cover to the E core.

7. The high voltage transformer as set forth in claim 6, wherein the shield cover comprises:

a fastening hole to allow the rivet to penetrate therethrough.

8. The high voltage transformer as set forth in claim 6, wherein the rivet fixedly attaches the shield cover to the E core.

9. The high voltage transformer as set forth in claim 6, wherein the shield cover is made of an insulating material.

10. The high voltage transformer as set forth in claim 7, wherein the temperature sensor comprises:

a frame to provide an external body of the temperature sensor;

an activating plate disposed to face the secondary coil and to sense the temperature of the secondary coil;

a plurality of input lines to electrically connect to the primary coil; and movable and fixed contact points disposed under the activating plate to control an on/off operation of the temperature sensor.

11. The high voltage transformer as set forth in claim 10, wherein the movable contact point is attached to and detached from the fixed contact point based on a temperature sensed inside the frame, and the movable contact point and the fixed contact point are electrically connected to the input lines.

12. The high voltage transformer as set forth in claim 6, wherein the shield cover is made of a transparent material to view the temperature sensor.

13. The high voltage transformer as set forth in claim 10, wherein the shield cover is extended in a direction to enclose the frame of the temperature sensor.

14. The high voltage transformer as set forth in claim 10, wherein a surface of the frame is stuck to the shield cover to prevent the frame from sliding out from the shield cover.

15. The high voltage transformer as set forth in claim 10, wherein the input lines are connected to one side of the frame to protrude outside the shield cover, and are connected in series to the primary coil.

16. The high voltage transformer as set forth in claim 7, further comprising:

a through hole provided on the E core to align with the fastening hole of the shield cover, wherein the rivet fixedly attaches the temperature sensor to the E core by passing through the through hole and the fastening hole.

17. The high voltage transformer as set forth in claim 8, further comprising:

a ground line to connect to one side of the secondary coil; and a ground element to connect to the ground line, and to ground the secondary coil to the E core via the rivet.

18. The high voltage transformer as set forth in claim 7, further comprising:

an installation space provided between a curved portion of the secondary coil and the E core, wherein the temperature sensor is disposed in the installation space.

19. The high voltage transformer as set forth in claim 10, wherein the temperature sensor is connected in series to the primary coil, and is fixedly attached to the E core by the rivet so that the activating plate of the temperature sensor is positioned to face the secondary coil, preventing a shifting of the temperature sensor.

20. The high voltage transformer as set forth in claim 11, wherein when the temperature of the secondary coil is equal to or higher than a preset temperature, the movable contact point is not connected to the fixed contact point, turning the temperature sensor off and preventing overheating of the high voltage transformer.

* * * * *